US005251560A

United States Patent [19]

Ban et al.

[11] Patent Number: 5,251,560

[45] Date of Patent: Oct. 12, 1993

[54] WATER-FLOAT COUPLING DEVICE

[75] Inventors: Koichiro Ban; Akihiko Tanaka; Magohei Tsukamoto; Toshi Goto, all of Shizuoka, Japan

[73] Assignee: Yamaha Hatsudoki Kabushiki Kaisha, Shizuoka, Japan

[21] Appl. No.: 930,244

[22] Filed: Aug. 6, 1992

[30] Foreign Application Priority Data

Jun. 11, 1992 [JP] Japan ..... 4-152411

[51] Int. Cl.[5] ..... B63B 3/08

[52] U.S. Cl. ..... 114/266

[58] Field of Search ..... 114/263, 266

[56] References Cited

U.S. PATENT DOCUMENTS 3,152,568 10/1964 Mayer .

4,604,962 8/1986 Guibault ..... 114/266

FOREIGN PATENT DOCUMENTS 136127 6/1990 China .

158814 5/1991 China .

385903 9/1990 European Pat. Off. ..... 114/266

1-273783 11/1989 Japan .

*Primary Examiner*—Jesûs Sotelo

*Attorney, Agent, or Firm*—Finnegan, Henderson, Farabow, Garrett & Dunner

[57] ABSTRACT

In order to provide a water-float coupling device which, even when floats on the water are moved relative to one another, for instance, by waves, prevents the floats from being unintentionally disconnected from one another, a water-float coupling device according to the present invention comprises: tightening member 15 for maintaining, when a locking part 11 is engaged with fastening member 9 to connect a plurality of floats 2 to one another, the locking part 11 engaged with the fastening member 9.

18 Claims, 20 Drawing Sheets

WATER-FLOAT COUPLING DEVICE

BACKGROUND OF THE INVENTION

This invention relates to a device for coupling a plurality of floats on the water (hereinafter referred to as "water-floats", when applicable) to one another to form an artificial floating island for recreation or a floating pier such as a pontoon (hereinafter referred to as "a water-float coupling device", when applicable).

A water-float coupling device of this type has been disclosed by Japanese Patent Application No. 103388/1988.

The conventional device includes locking means for detachably locking a plurality of floats on the water to one another, thereby to provide an artificial floating island or the like.

On the other hand, sometimes big waves are formed on the water, especially in the ocean. In such a case, the floats coupled to one another may be moved up and down or swung with respect to one another; that is, they may suffer from relative movement. The relative movement may disconnect the floats from one another because they are simply locked to one another with the locking means.

SUMMARY OF THE INVENTION

In view of the foregoing, it is an object of this invention to provide a water-float coupling device which, even when floats are greatly moved relative to one another, prevents the floats from being unintentionally disconnected from one another.

The foregoing object of the invention has been achieved by the provision of a water-float coupling device which, according to a first aspect of the present invention, comprises: tightening means for maintaining, when its locking part is engaged with fastening means to connect a plurality of floats to one another, the locking part engaged with the fastening means.

The water-float coupling device according to the first aspect of the invention functions as follows:

When the locking part is engaged with the fastening means to connect a plurality of floats to one another on the water, the tightening means (15 or 44) acts to maintain the locking part engaged with the fastening means.

Hence, the floats are more positively connected to one another than in the prior art in which they are connected merely with the locking means.

In addition, the foregoing object of the invention has been achieved by the provision of a float coupling device comprising: fastening means provided on the sides of each of a plurality of floats which can be floated on water; and a locking part which can be detachably engaged with the fastening means, in which, according to a second aspect of the present invention, the locking part comprises a first locking member, and a second locking member, the first locking member comprising a central shaft, and arms extended radially from the lower end of the central shaft, the arms having elastic hooks engageable with retainers of the second locking members, the second locking member having a central hole into which the first locking member is inserted, and retainers located radially outwardly of the central hole which are inserted into the fastening means provided on the side of the floats, with the central shaft of the first locking member inserted into the central hole, the first locking member being turned about the central axil until the elastic hooks are engaged with the retainers.

The float coupling device is used as follows: First, the fastening means provided on the sides of floats to be connected to one another are put together, and then the retainers of the second locking member are inserted into the fastening means thus put together. Under this condition, the central shaft of the first locking member is inserted into the central hole of the second locking member in such a manner that the arms of the first locking member are positioned between the retainers of the second locking member. Under this condition, the first locking member is turned so that the elastic hooks of the first locking member are engaged with the retainers of the second locking member; that is, the former are engaged with the latter by one action, to connect the floats to one another.

By connecting other floats in the same manner, one artificial floating island is formed. With the float coupling device, the floats will never be unintentionally disconnected from one another even when they are moved with respect to one another.

Figure 12:
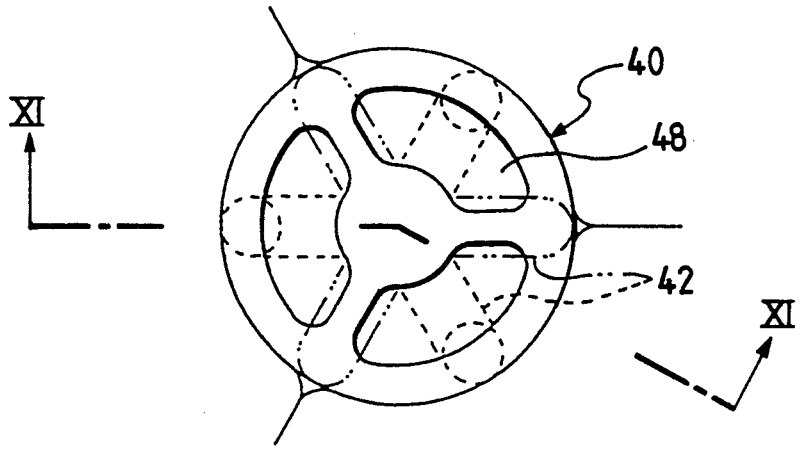
FIG. 12 is a plan view of a coupling device in the third embodiment.
Figure 16A:
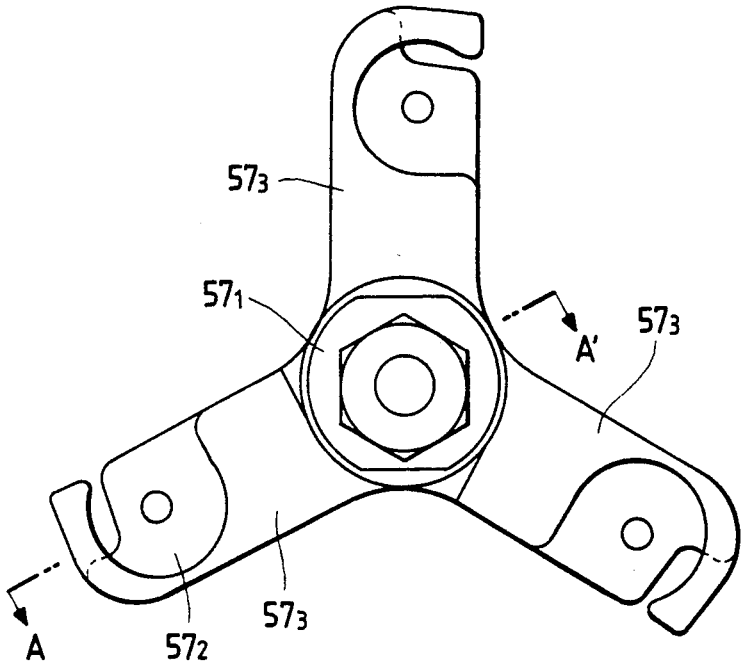
Figure 16B:
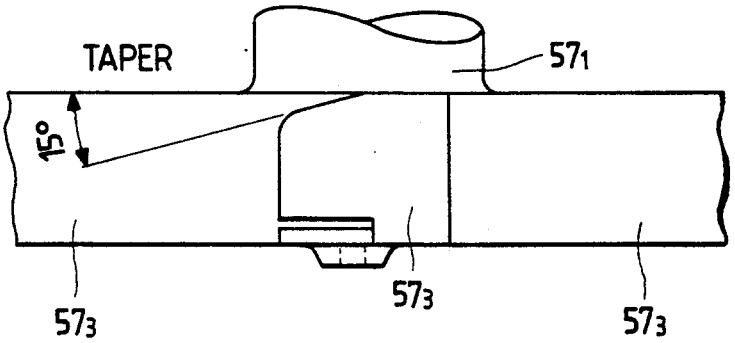
Figure 17:
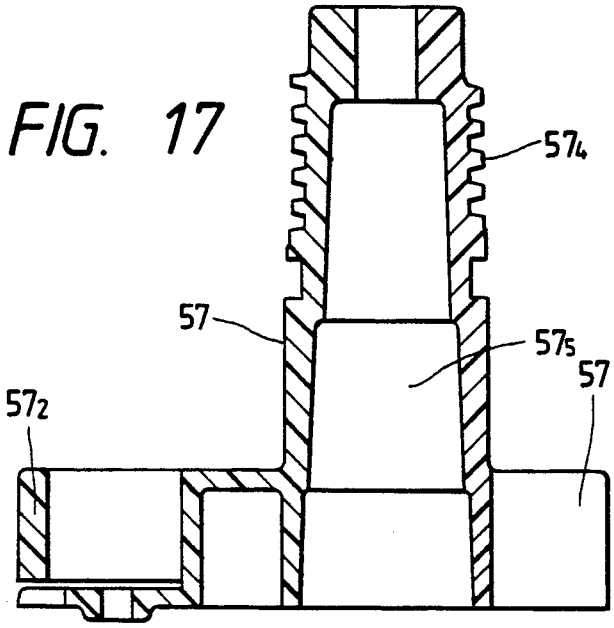
Figure 18:
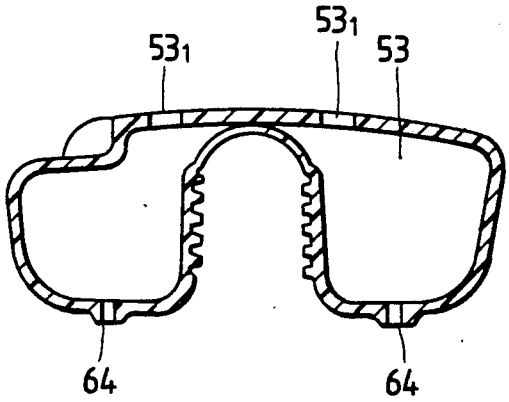
Figure 19:
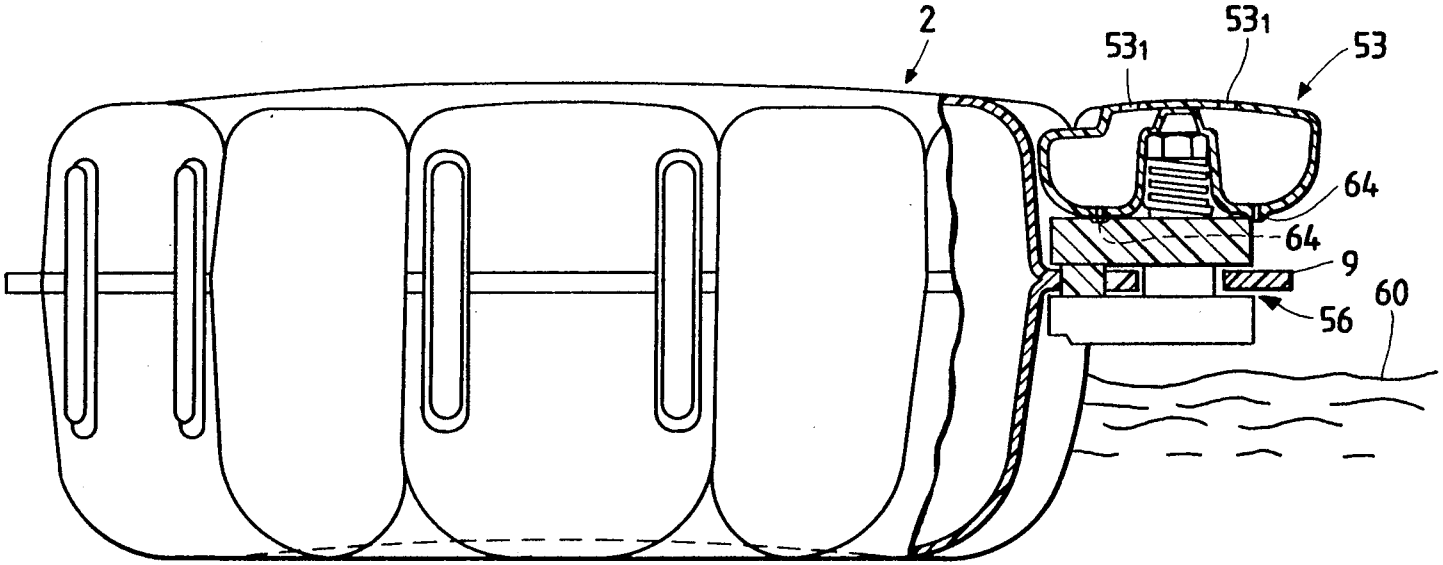
Figure 20:
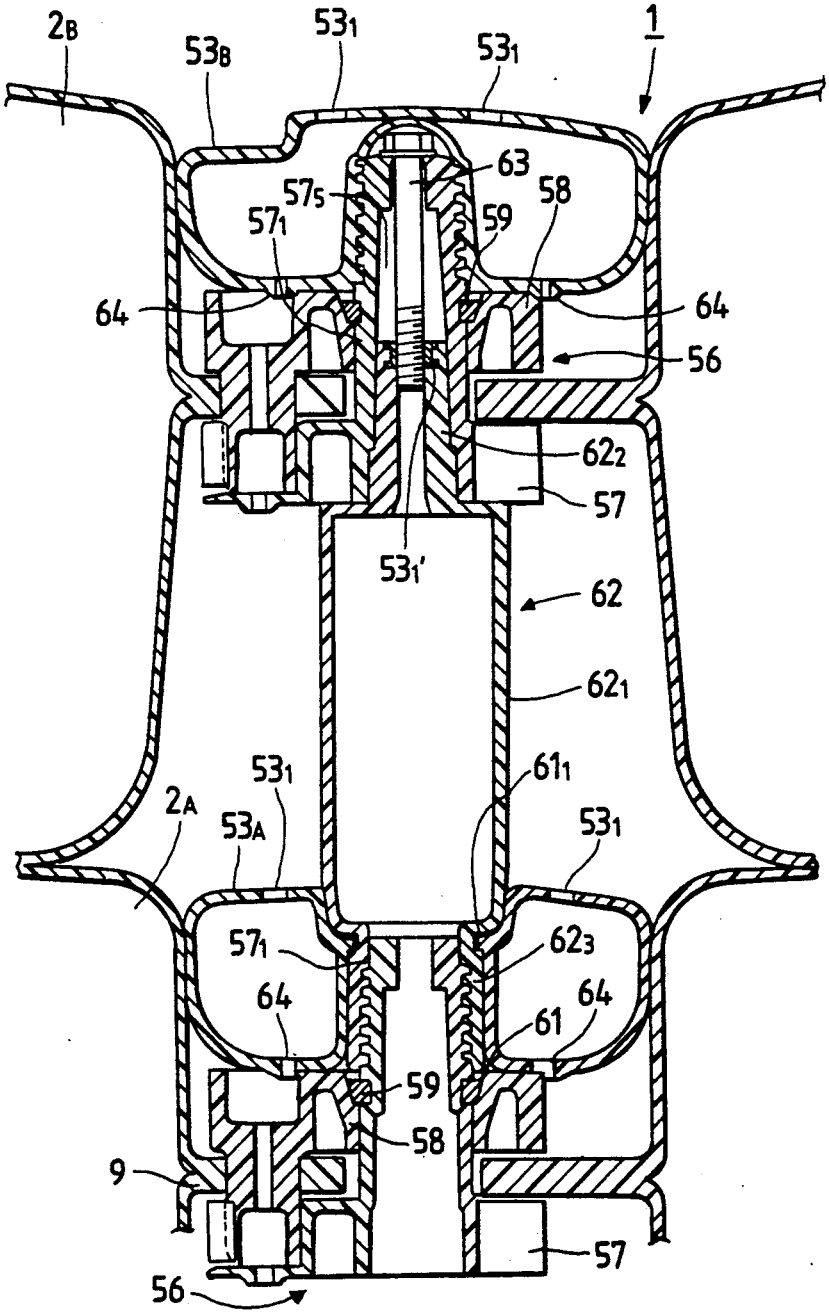
Figure 21:
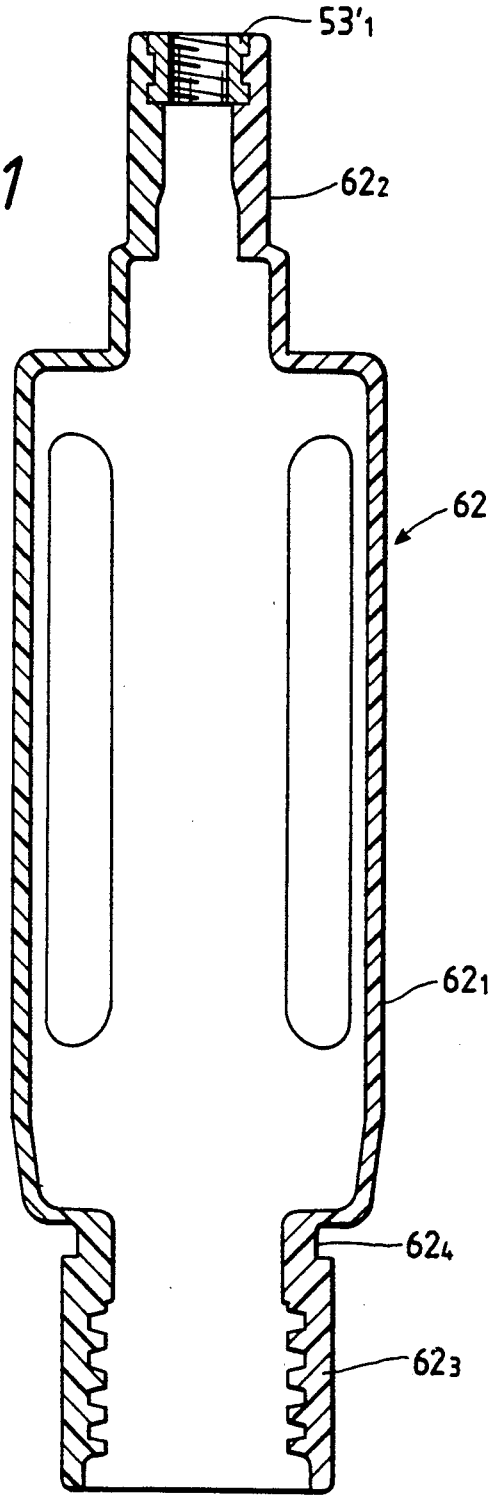
Figure 22:
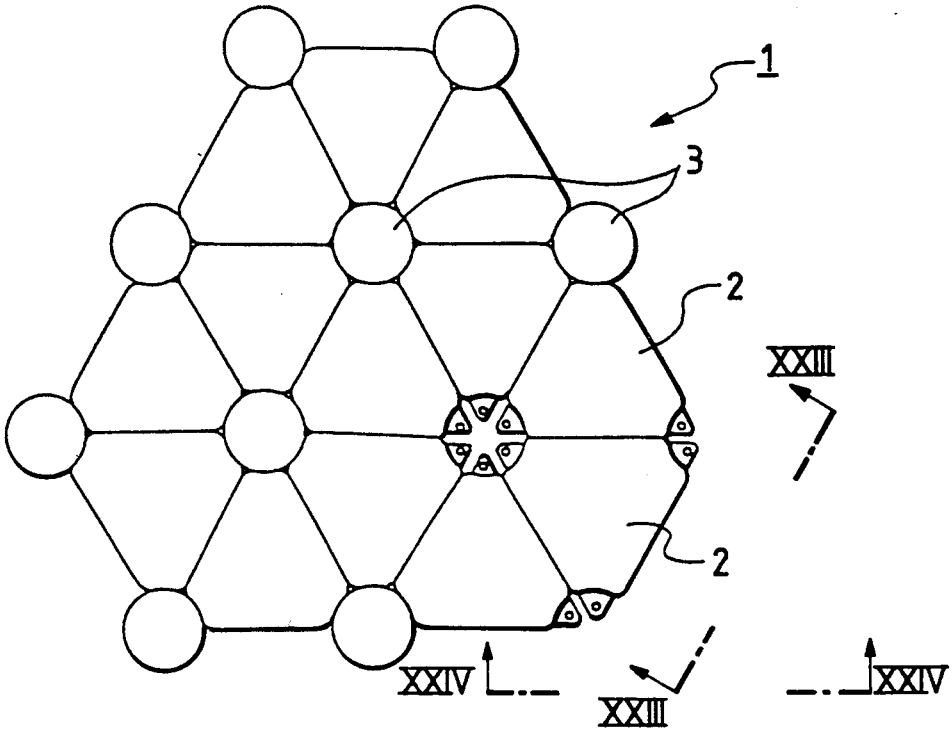
Figure 23:
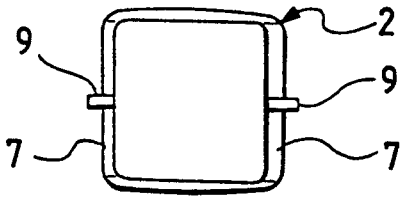
Figure 24:
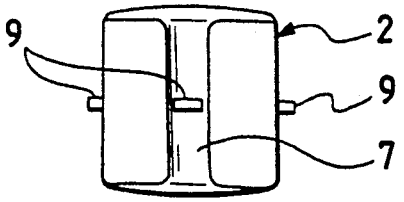
Figure 25:
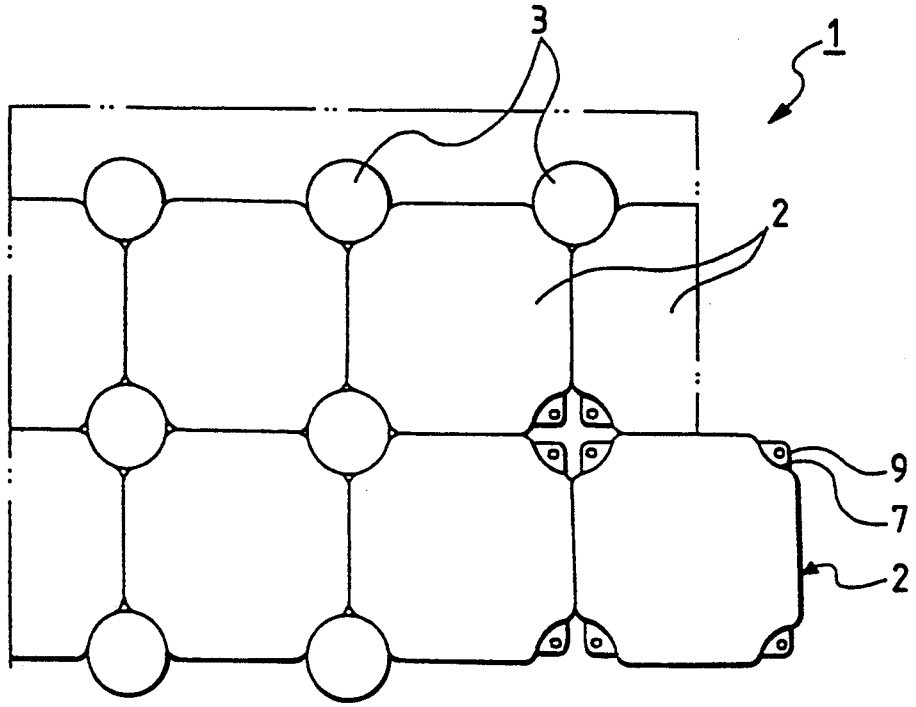
Figure 27:
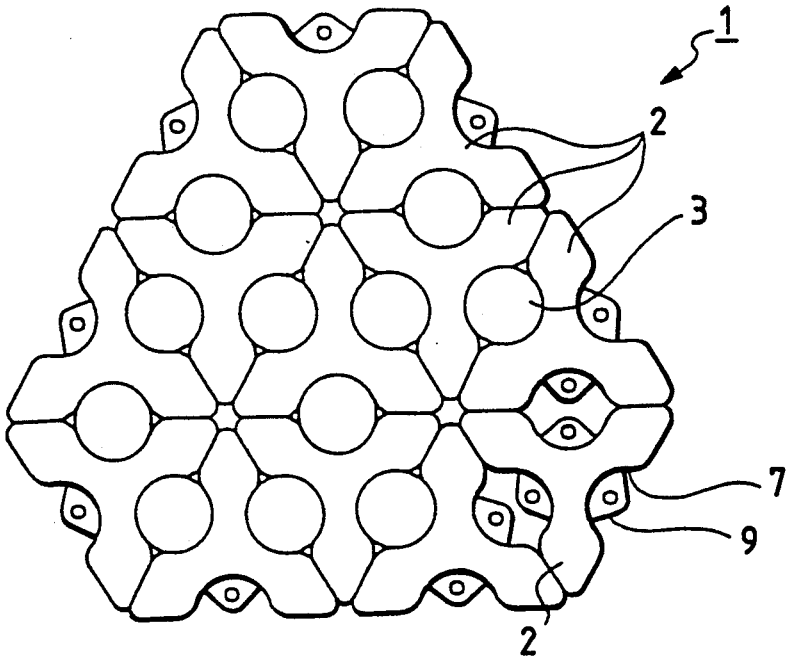
Figure 26:
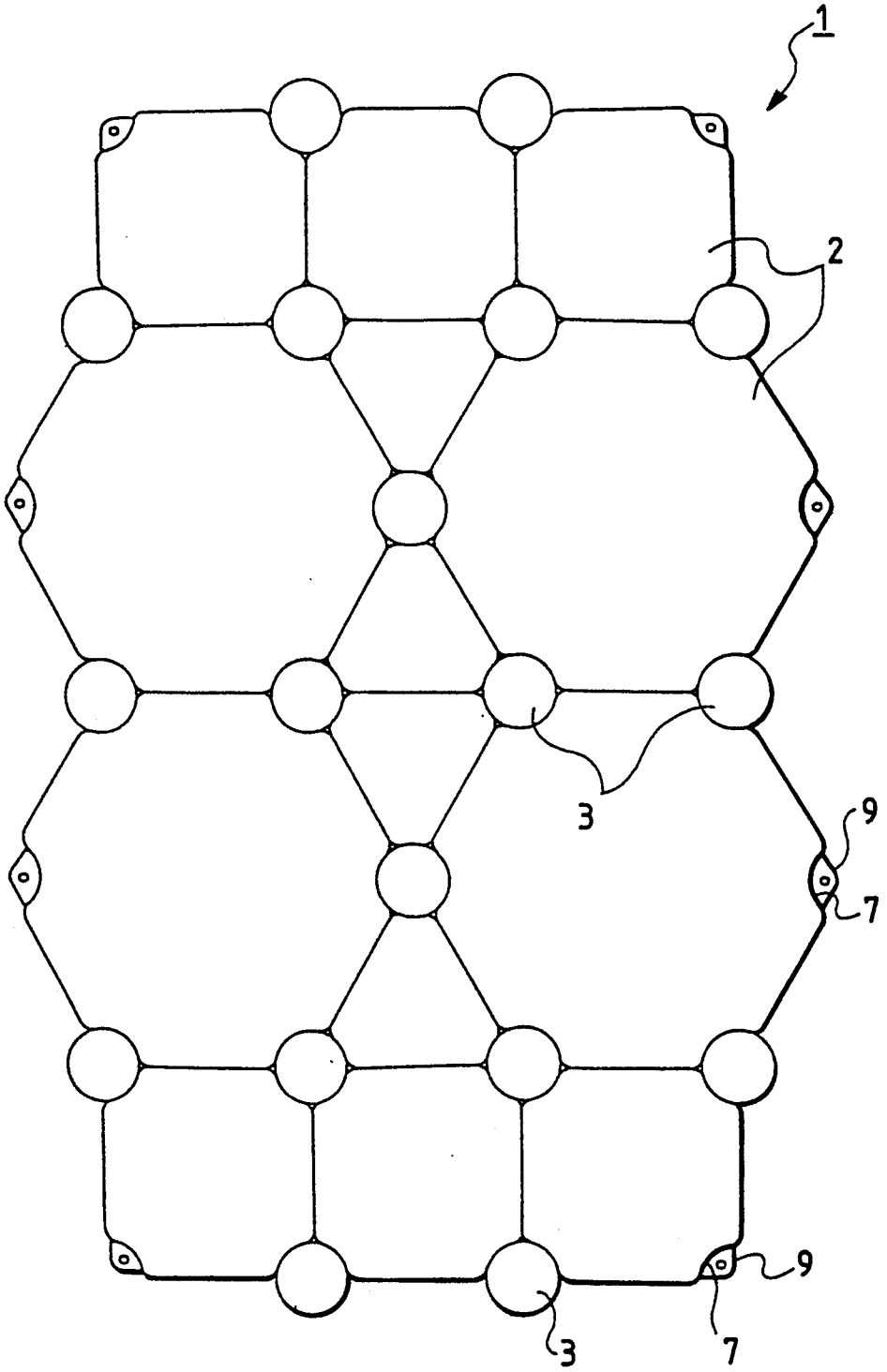
Figure 28:
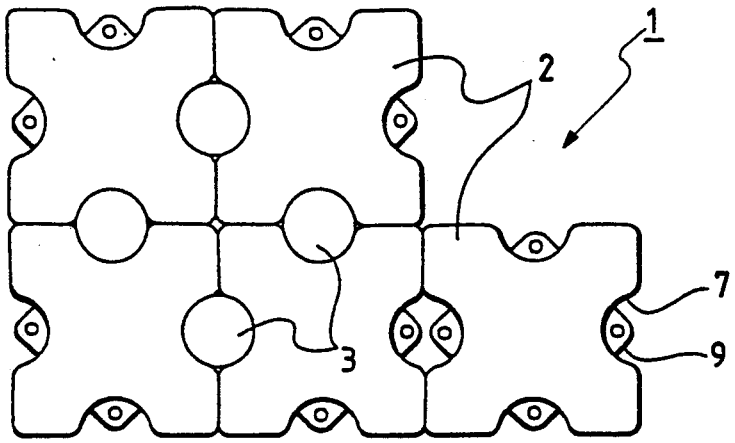
Figure 29:
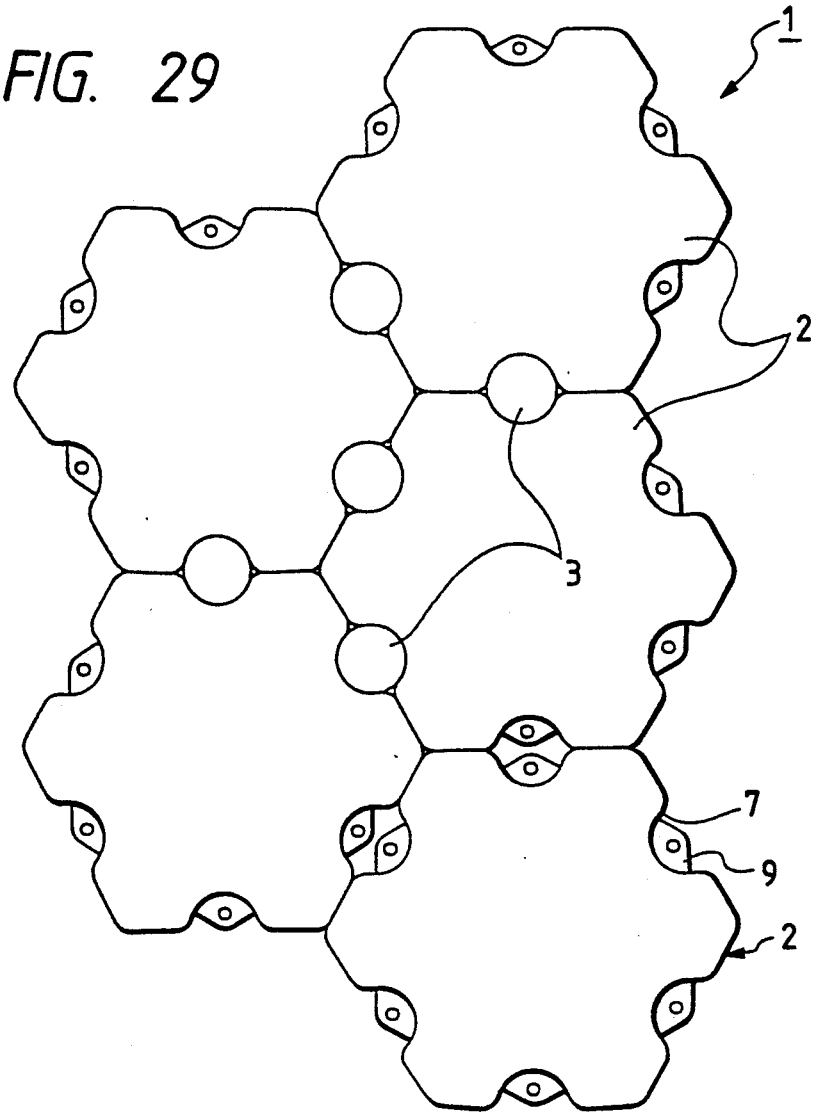
Figure 30:
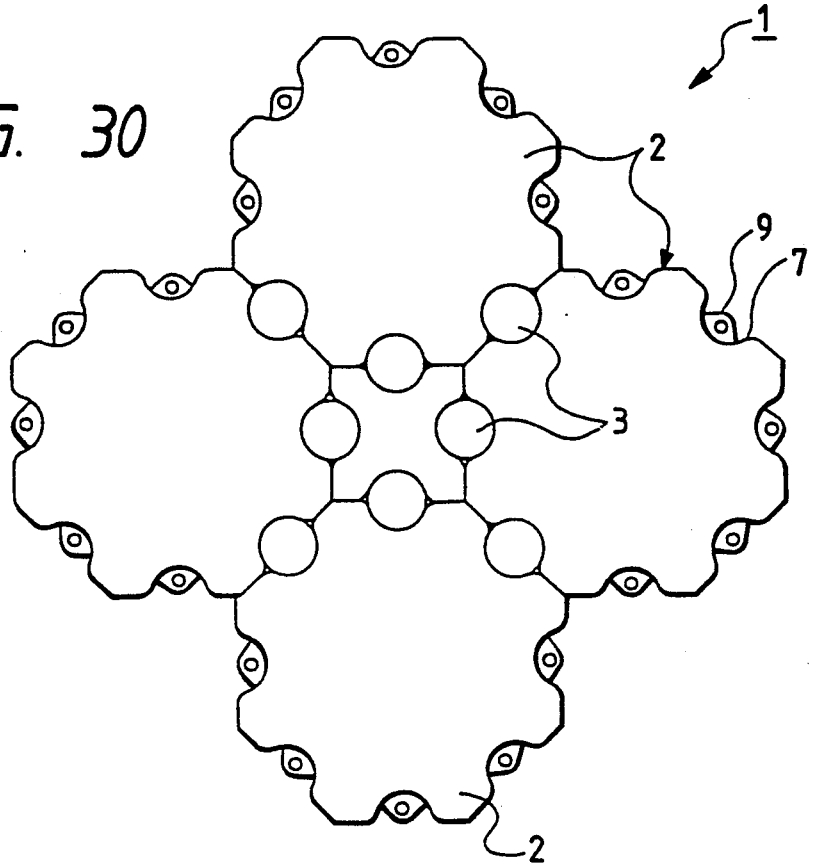

The part (a) of FIG. 16 is a plan view of an axle joint forming the float coupling device, and part (b) of FIG. 16 is a fragmentary side view of the axle joint;

FIG. 17 is a sectional view of the axle joint taken along line A—A' in the part (a) of FIG. 16;

FIG. 18 is a sectional view of a cover member of the float coupling device;

FIG. 19 is a sectional view showing one of the floats on the water which are coupled to one another with the float coupling device;

FIG. 20 is a sectional view showing an auxiliary cover member which is used when floats are stacked for the purpose of storage or use;

FIG. 21 is a sectional view of a stay rod used for connecting the float coupling devices shown in FIG. 12;

FIG. 22 is a plan view of an artificial floating island, showing a fifth embodiment of the invention;

FIG. 23 is a side view of a float taken in the direction of arrow XXIII—XXIII in FIG. 22;

FIG. 24 is a side view of the float taken in the direction of arrow XXIV—XXIV in FIG. 22;

FIG. 25 is a plan view of an artificial floating island, showing a sixth embodiment of the invention;

FIG. 26 is a plan view of an artificial floating island, showing a seventh embodiment of the invention;

FIG. 27 is a plan view of an artificial floating island, showing a eighth embodiment of the invention;

FIG. 28 is a plan view of an artificial floating island, showing an ninth embodiment of the invention;

FIG. 29 is a plan view of an artificial floating island, showing a tenth embodiment of the invention; and FIG. 30 is a plan view of an artificial floating island, showing a eleventh embodiment of the invention.

Figure 31:
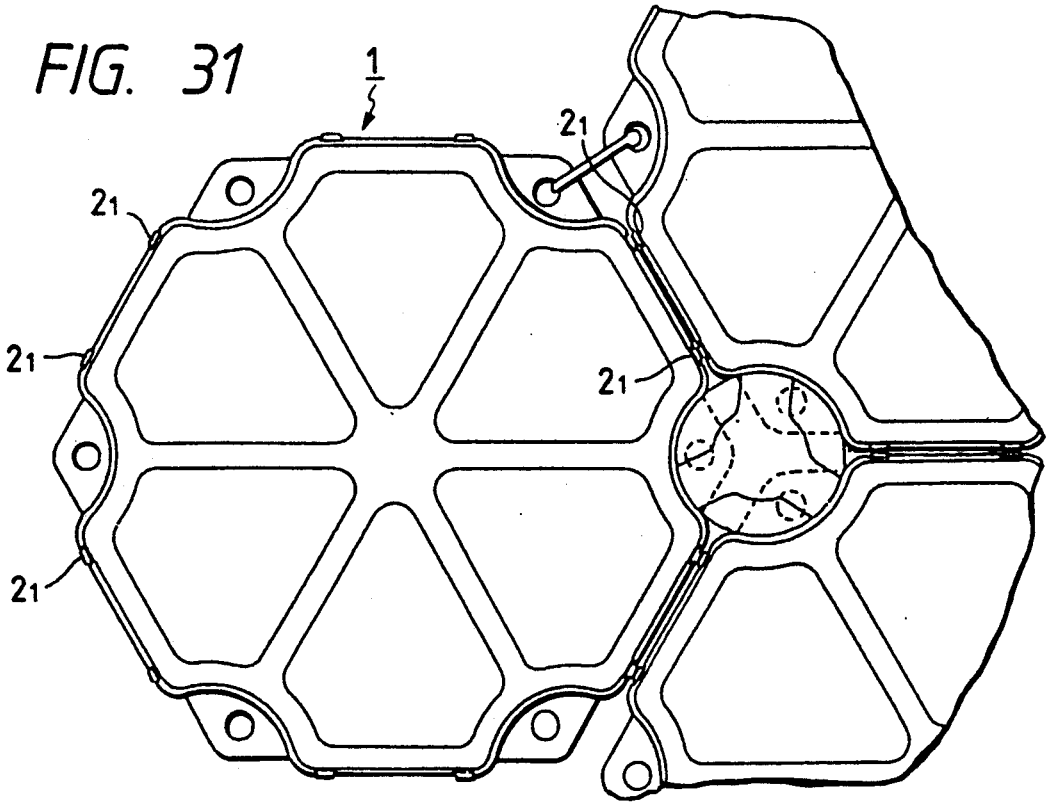

FIG. 31 is a substantially horizontal sectional view of floats connected to one another in fourth embodiment of the invention.

DETAILED DESCRIPTION OF THE PREFERRED EMBODIMENTS

Preferred embodiments of this invention will be described with reference to the accompanying drawings.

EMBODIMENT

FIGS. 1 through 8 show a first embodiment of the invention.

Figure 2:
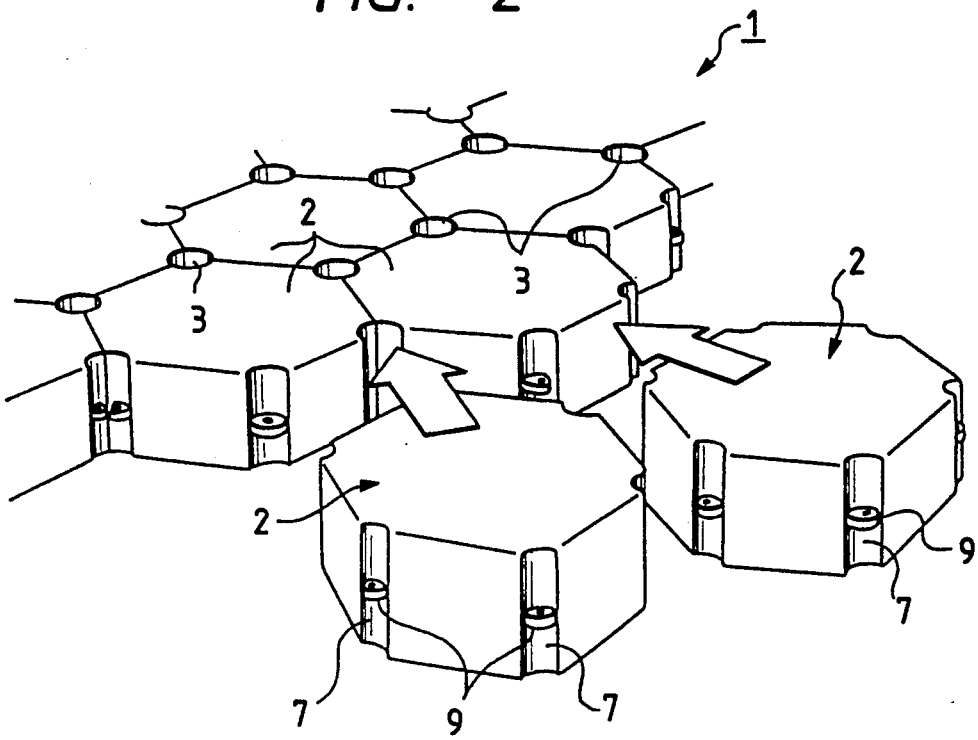
FIG. 2 is a perspective view of an artificial floating island.
Figure 4:
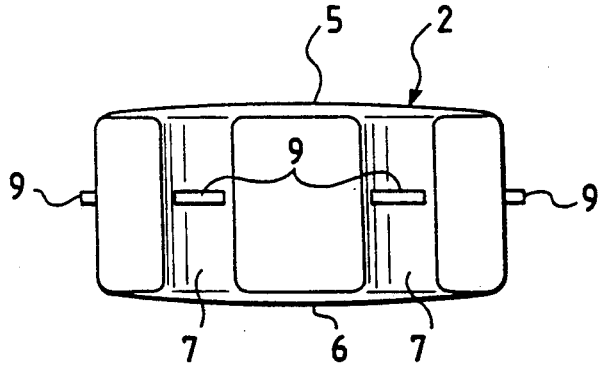
FIG. 4 is a side view of a float taken in the direction of line IV—IV in FIG. 3.
Figure 5:
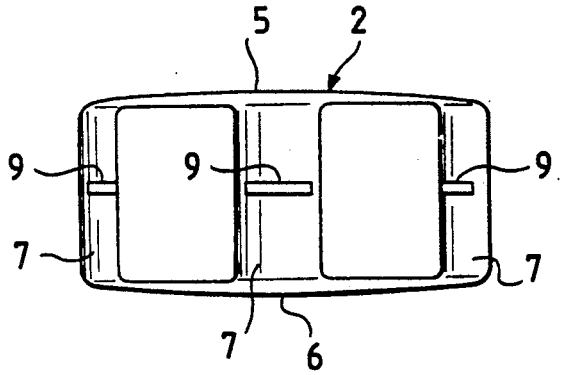
FIG. 5 is a side view of the float taken in the direction of line V—V in FIG. 3.
Figure 3:
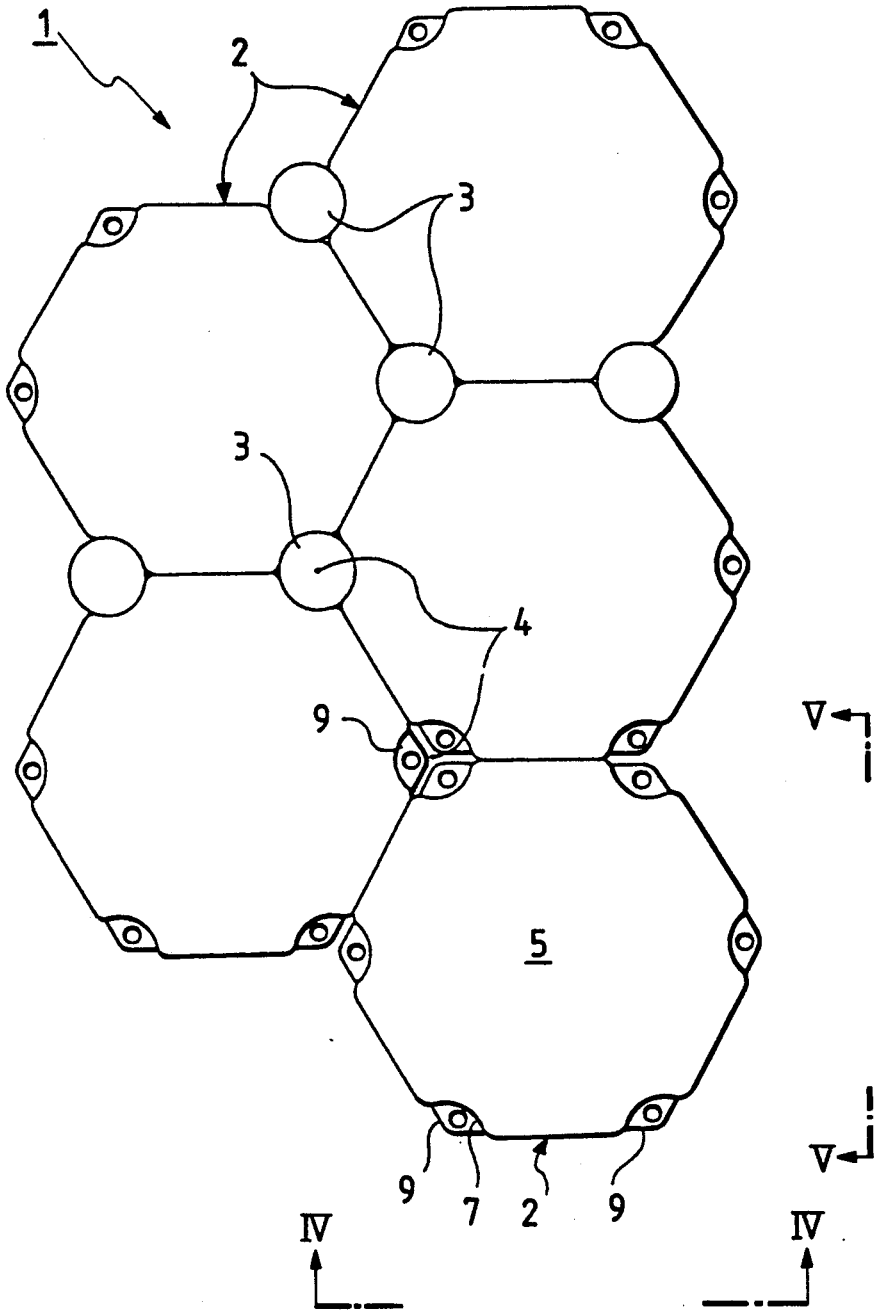
FIG. 3 is a plan view of the floating island.

In FIGS. 2 and 3, reference numeral 1 designates an artificial flat floating island which is floated on the water in a sea, lake or the like. The floating island 1 is made up of a number of floats arranged side by side, and coupling devices 3 for coupling those floats to one another.

The floats 2 are similar in configuration to one another; that is, each of the floats 2 is in the form of a regular-hexagonal prism. The floats 2 are arranged side by side in such a manner that three floats are set around a vertical axis 4 with no space therebetween, and the coupling devices 3 are used in such a manner that one coupling device is provided for every three floats thus set, to couple the corners of those floats to one another.

As shown in FIGS. 1, 3, 4 and 5, each of the floats 2 is a hollow structure made of polyethylene resin. The float 2 has a top wall 5 and a bottom wall 6. The top wall is curved upwardly to cause water to flow quickly down the top wall 5 and to give a predetermined mechanical strength to it. A number of protrusions (not shown) are formed on the surface of the top wall 5 so as to prevent persons walking or running on the floating island 1 from slipping. The bottom wall 6 is symmetrical in configuration with the top wall 5, being curved downwardly. That is, even when the float is set upside down, it can be used as it is. The float 2 has six vertical grooves 7 respectively at six corners as viewed from above which are arcuate in section and extended vertically.

The coupling devices 3 will be described with reference to FIGS. 1 through 5.

The coupling devices 3 are made of the same material as the floats 2. Each coupling device 3 is connected to fastening means which are protruded from the side walls of the floats 2, namely, protruded pieces 9. More specifically, the protruded piece 9 is located at the middle of the vertical groove and extended from the bottom of the vertical groove 7 horizontally outwardly, and has a locking hole 10 cut axially.

As was described above, a number of floats 2 are arranged side by side in such a manner that three floats are set around one vertical axis 4 with no space therebetween. Accordingly, at each vertical axis 4, a cylindrical hole 8 is formed by the three vertical grooves 7. Therefore, in the cylindrical hole 8, the locking holes 10 of the protruded pieces 9 of the three floats are arranged around the vertical axis 4 at equal angular intervals.

Figure 1:
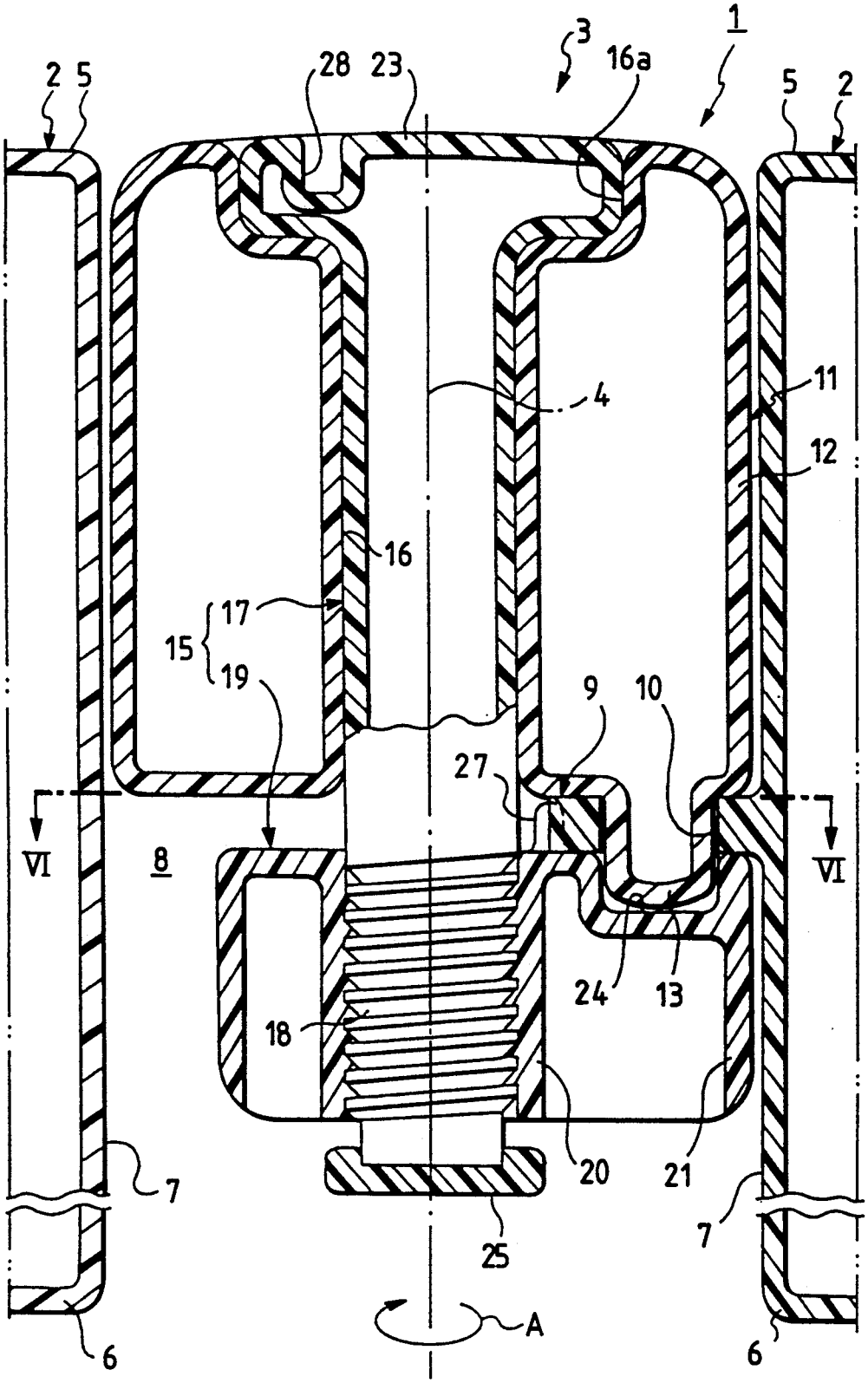
FIG. 1 is a sectional view of a coupling device.

In FIGS. 1, reference numeral 11 designates a locking part, which comprises: a locking part body 12 which is annular as viewed from above; and three locking protrusions 13 which are extended from the bottom of the annular locking part body 12 and arranged around the central axis of the locking part body 12 at equal angular intervals. The locking part body 12 is positioned coaxial with the aforementioned vertical axis 4.

When the locking part body 12 is inserted into the cylindrical hole 8, the three locking protrusions 13 are detachably engaged with the three locking holes 10, respectively, which are positioned around the vertical axis as was described above, so that the floats 2 are coupled to one another.

The locking part 11 is a hollow structure, which contributes to reduction of the weight of the locking part 11 and to provision of buoyancy.

Figure 6:
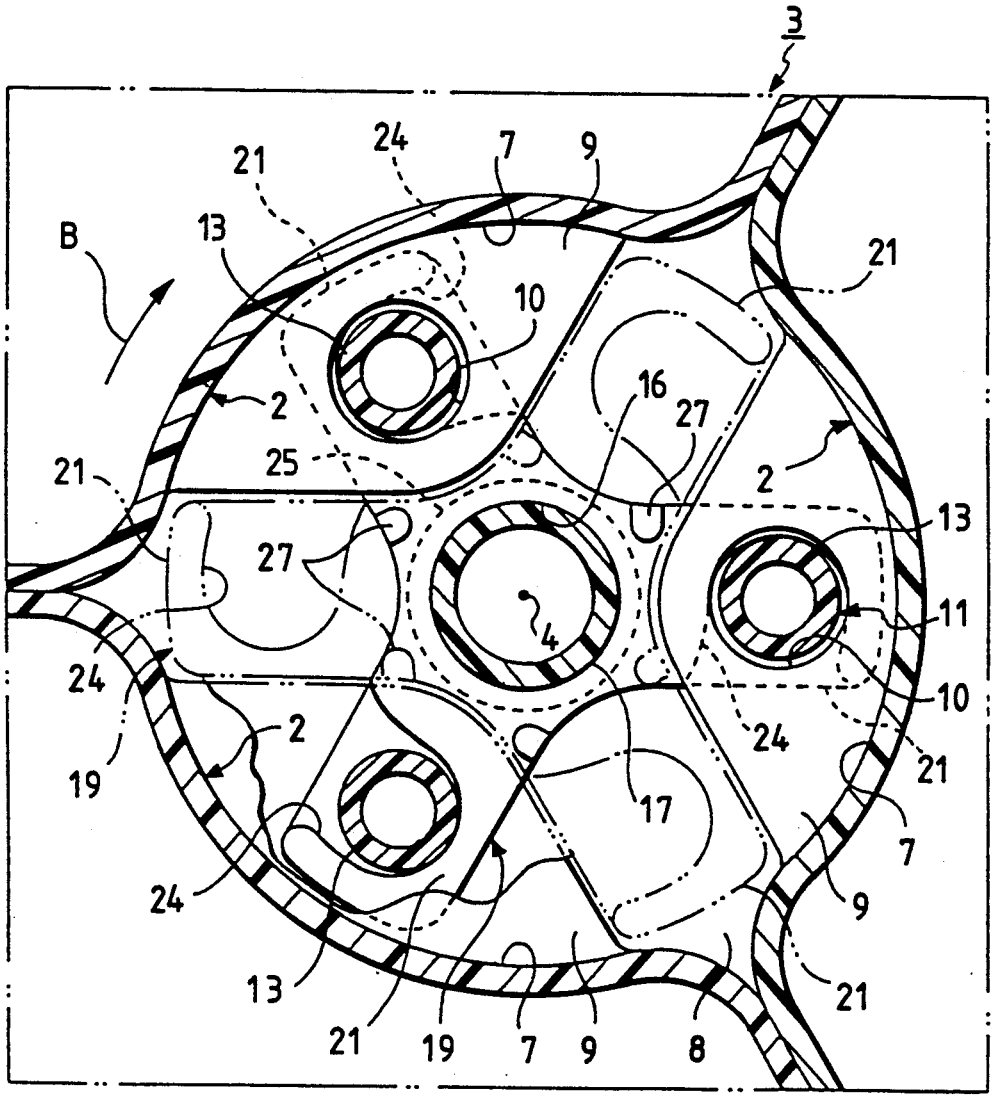
FIG. 6 is a fragmentary sectional view taken along line V6—V6 in FIG. 1.

In order to hold the locking part 11 locked to the protruded pieces 9, tightening means 15 is provided as shown in FIGS. 1 and 6

The tightening means 15 includes a bolt 17 which is inserted into a central hole 16 from above. The lower end portion of the bolt 17 is threaded as indicated at 18, and a nut 19 is engaged with the threaded lower end portion 18 of the bolt 17. The nut 19 comprises: a nut body 20 which is engaged with the threaded lower end portion 18 of the bolt 17; and three arms 21 which are extended from the nut body radially outwardly as viewed from above and arranged around the central axis at equal angular interval. When the nut 19 is threadably engaged with the bolt 17, the head 23 of the bolt 17 and the arms 21 of the nut 19 clamp the protruded pieces 9 and the locking part 11 from above and below which have been locked to one another, so that the locking part 11 is held locked to the protruded pieces 9.

In this operation, the head 23 of the bolt 17 is inserted into an annular recess 16*a* formed in the central hole 16 at the upper end, so that the upper surfaces of the floats 2, the locking body 12, and the head 23 of the bolt 17 are substantially flush with one another. The upper surfaces of the locking part body 12 and the head 23 of the bolt 17 form parts of the upper surface of the floating island.

An engaging recess 24 is formed in the upper surface of each of the arms 21 of the nut. The lower end portion of each of the locking protrusions 13 engaged with the locking holes 10 is extended downwardly through the locking hole 10. That is, the lower end portions of the locking protrusions 13 is detachably engaged with the engaging recesses 24 when the bolt 17 and the nut 19 are turned about the vertical axis 4 relative to each other.

When the bolt 17 is turned in the direction of the arrow A in FIG. 1 (or in the tightening direction), the nut 19 tends to turn in the same direction; however, in this operation, the engaging recesses 24 are engaged with the lower end portions of the locking protrusions 13, thus preventing the nut from being turned in the same direction.

A stopper 25 is welded to the lower end of each of the bolts 17. The stopper 25 acts as follows: When the nut 19 is moved down the threaded lower end portion 18 of the bolt while being turned around the latter, the stopper 25 prevents the upper surfaces of the engaging recesses 24 from coming below the lower ends of the locking protrusions 13.

Further in FIG. 1, reference numeral 27 designates turn-stopping protrusions for preventing the turning of the nut 19. When the bolt 17 is turned in the direction opposite to the direction of the arrow A in FIG. 1 (or in the loosening direction), the nut 19 tends to turn in the same direction. However, in this case, the turn-stopping protrusions 27 abut against the protruded pieces, so that the nut 19 is prevented from being turned in the same direction. Furthermore in FIG. 1, reference numeral 28 designates tool recesses with which a tool is engaged to turn the bolt 17.

Now, a procedure of coupling the floats 2 to one another with the above-described coupling devices 3, as indicated by the arrows in FIG. 2, three floats to be coupled to one another are set together around a vertical axis 4, thus defining the above-describe cylindrical hole 8.

Figure 7:
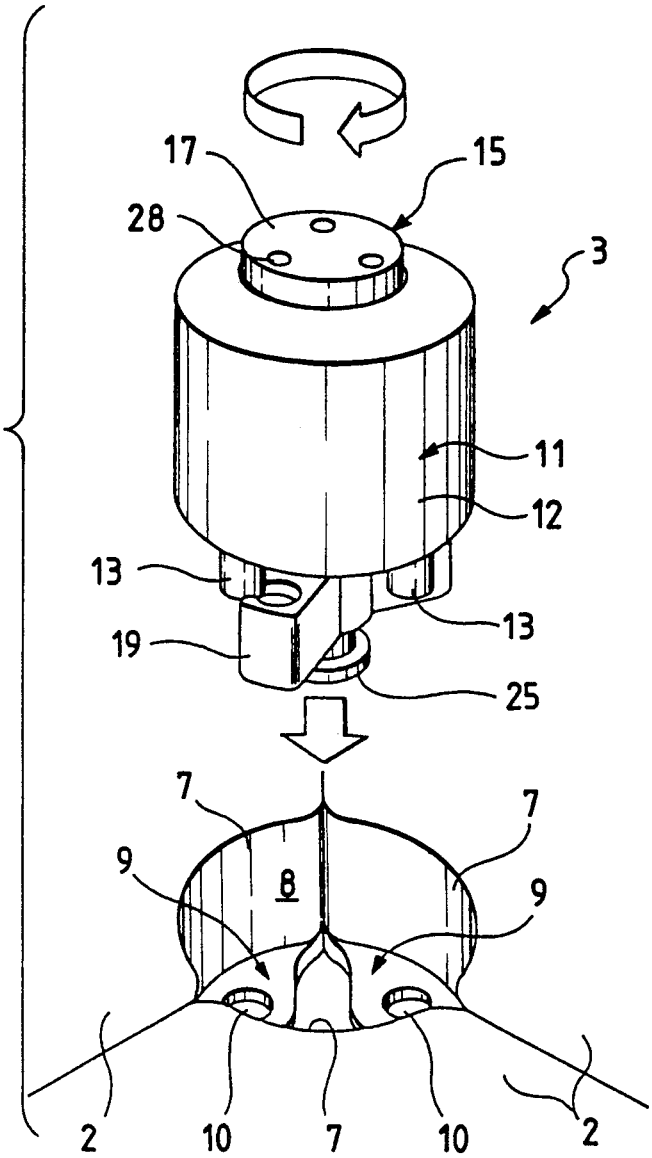
FIG. 7 is an exploded perspective view of the coupling device.

As shown in FIG. 7, the assembly of the locking part 11 and the tightening means 15 is inserted into the cylindrical hole 8 defined by the three floats. In this connection, it should be noted that, as indicated by the phantom lines in FIG. 6, the nut 19 can go into the space defined by the three protruded pieces 9. Therefore, the nut 19 is positioned in the space as indicated by the phantom lines. Under this condition, the locking part 11 is turned (in the direction of the arrow B in FIG. 6) to cause the lower ends of the locking protrusions 13 to disengage from the engaging recesses 24, and then the locking protrusions 13 are aligned with the locking holes 10, respectively. Thereafter, the locking part 11 together with the bolt 17 is moved downwardly to insert the locking protrusions 13 into the respective locking holes 10. In this operation, the nut 19 is moved downwardly together with the bolt 17, so that the former 19 is positioned below the protruded pieces 9. As a result, the floats 2 are locked to one another.

Figure 8:
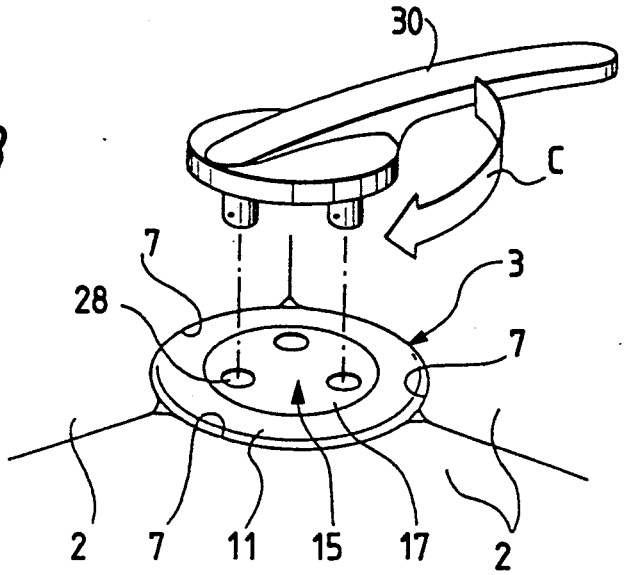
FIG. 8 is a perspective view for a description of an operation of the coupling device.

Next, as shown in FIG. 8, with the pawls of a spanner 30 engaged with the aforementioned tool recesses 28, the bolt 17 is turned in the direction of the arrow C in FIG. 8 (corresponding to the direction of the arrow A in FIG. 1 or the direction of the arrow B in FIG. 6) so that its threaded end portion 18 is threadably engaged with the nut 19. In this engaging operation, initially the nut 19 is turned together with the bolt 17 to cause the engaging recesses 14 to abut against the locking protrusions 13. That is, when the engaging recesses abut against the locking protrusion in the manner, the turning of the nut 19 together with the bolt is stopped.

When the bolt 17 is further turned, as shown in FIG. 1 the protruded pieces 9 and the locking part 11 are clamped by the tightening means from above and below, so that the protruded pieces 9 are maintained engaged with the locking part 11. Thus, the floats 2 have been coupled to one another.

The floats 2 can be disconnected from one another as follows: The bolt 17 is turned in the opposite direction, to loosen the nut 19. In this operation, initially the nut 19 tends to turn together with the bolt; however, soon the turn-stopping protrusions 27 abut against the protruded pieces 9, to stop the turning of the nut 19 together with the bolt 17. That is, the floats can be disconnected from one another by performing the above-described float connecting operation in reverse order. This can be also applied to other embodiments of the invention (described below).

SECOND EMBODIMENT

Figure 9:
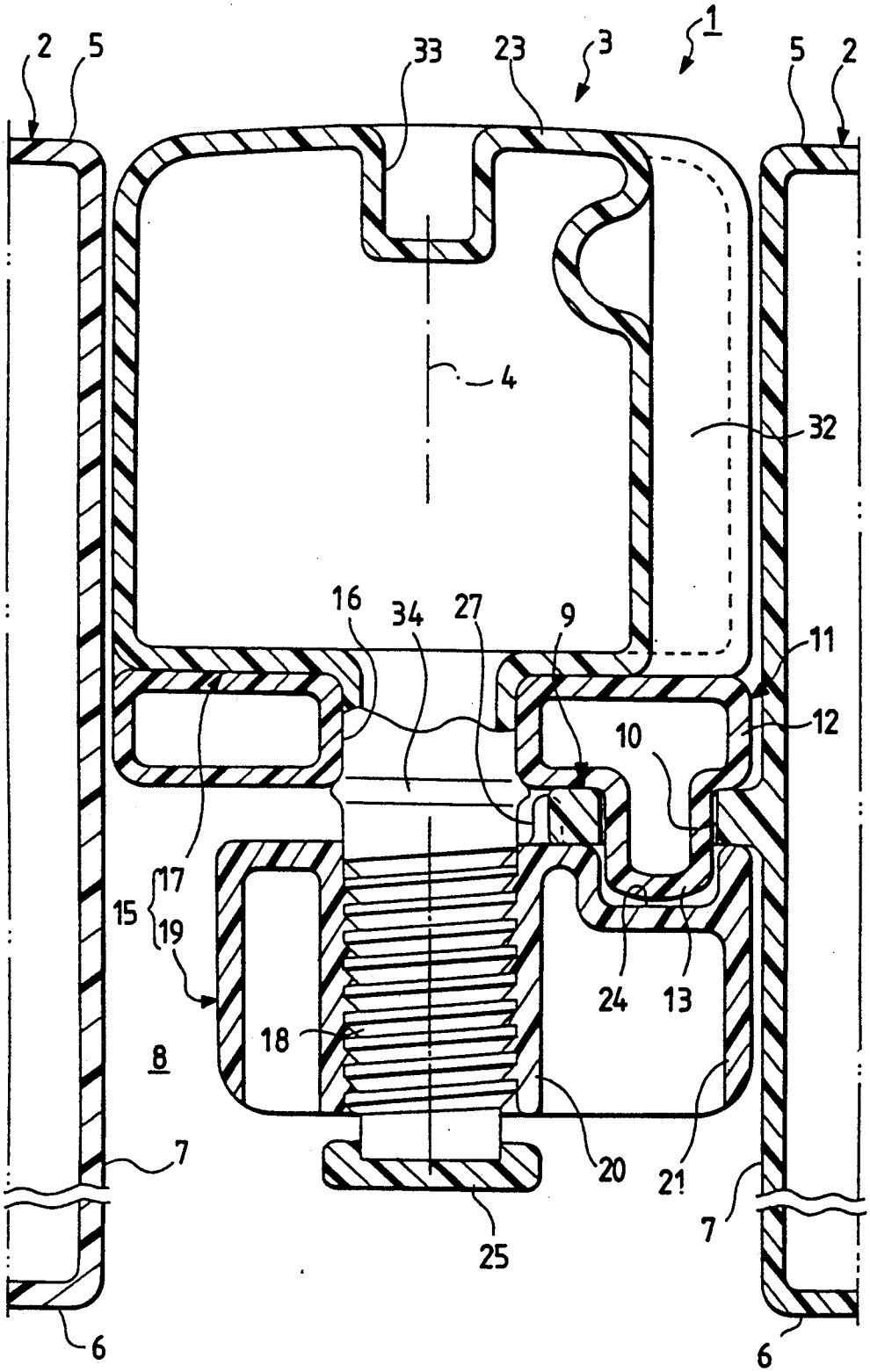
FIG. 9 is a sectional view taken along line IX—IX in FIG. 10, showing a second embodiment of the invention.
Figure 10:
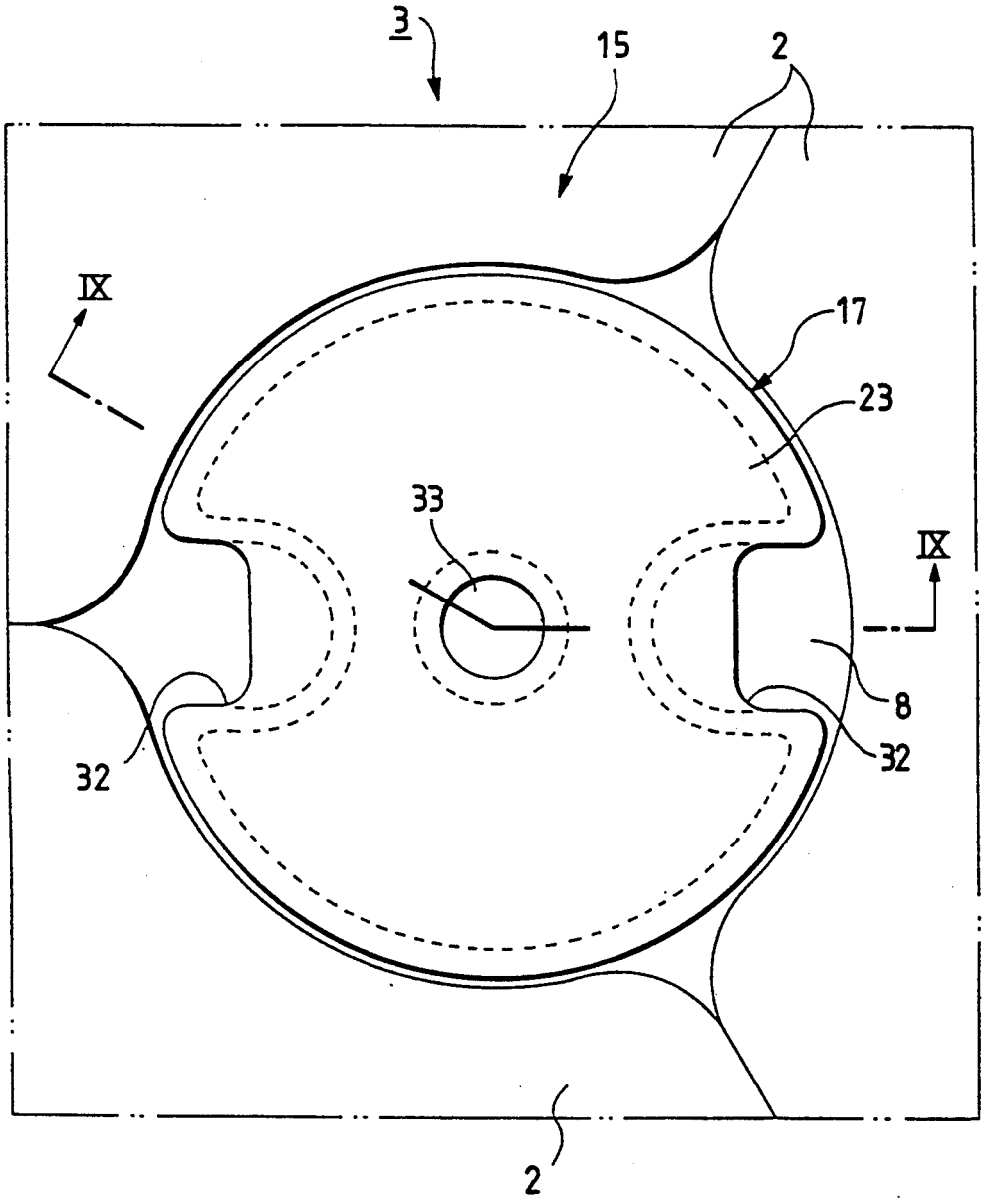
FIG. 10 is a plan view of a coupling device in the second embodiment.

FIGS. 9 and 10 show a second embodiment of the invention.

In the second embodiment, the head 23 of a bolt 17 is large enough to fit in the cylindrical hole 8, to cover the locking part body 12 of a locking part 11. The head 23 of the bolt 17 has vertical engaging grooves 32 in the cylindrical wall in such a manner that the engaging grooves 32 are positioned diametrically opposite to each other. The engaging grooves 32 are used as follows: When the bolt 17 is to be turned, the spanner 30 is engaged with the engaging grooves 32, or the fingers of the operator are fitted in them.

The head 23 has a central recess 33 at the center, which may be utilized for instance as follows: The pole of a flag or sunshade may be fitted in the central recess 33.

Further in FIG. 9, reference numeral 34 designates an annular protrusion for preventing the locking part body 12 from coming off the threaded end portion 18 of the bolt 17. That is, the annular protrusion 34 and the head 23 of the bolt 17 clamp the locking part body 12 to prevent the latter 12 from coming off the threaded end portion 18 of the bolt 17 unintentionally.

THIRD EMBODIMENT

Figure 11:
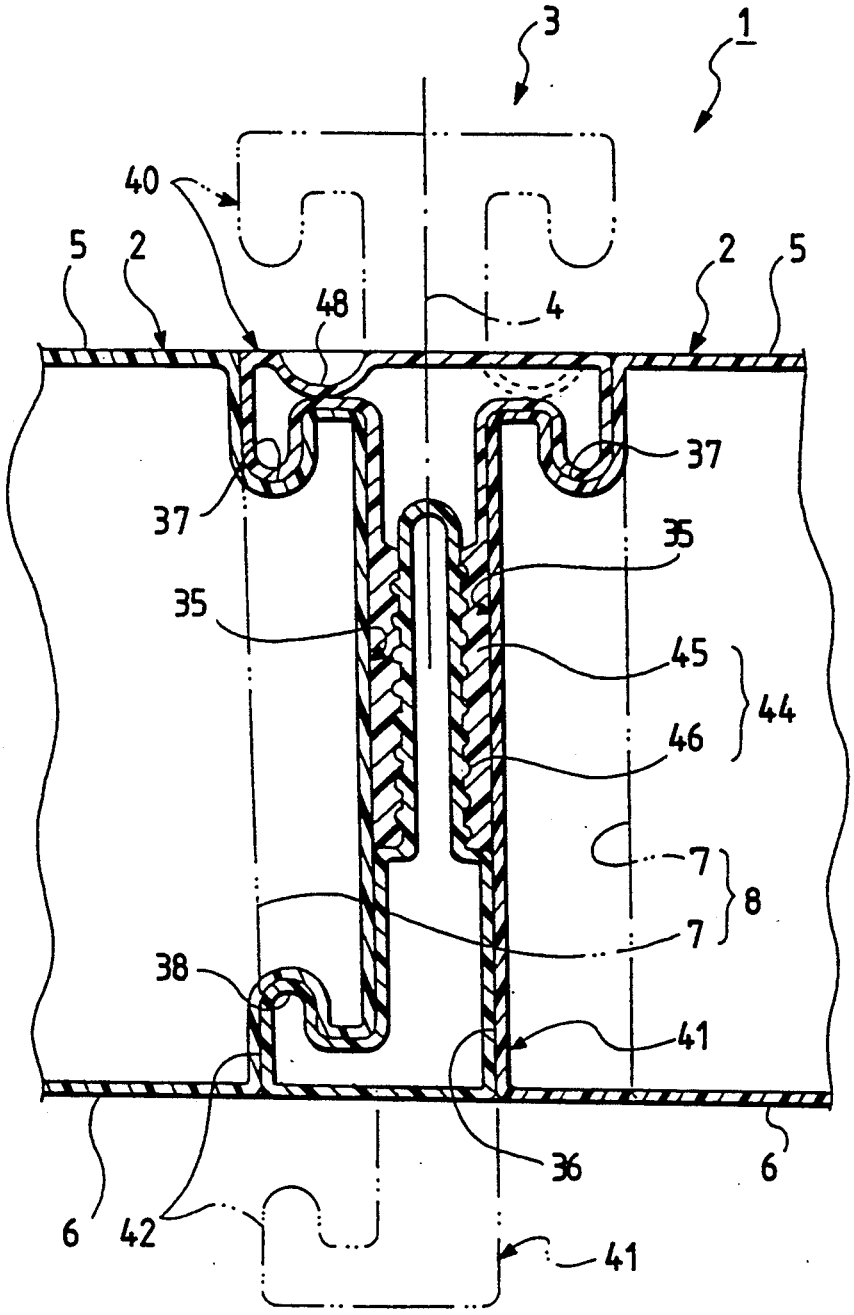
FIG. 11 is a fragmentary sectional view taken in the direction of arrow XI—XI in FIG. 12, showing a third embodiment of the invention.
Figure 13:
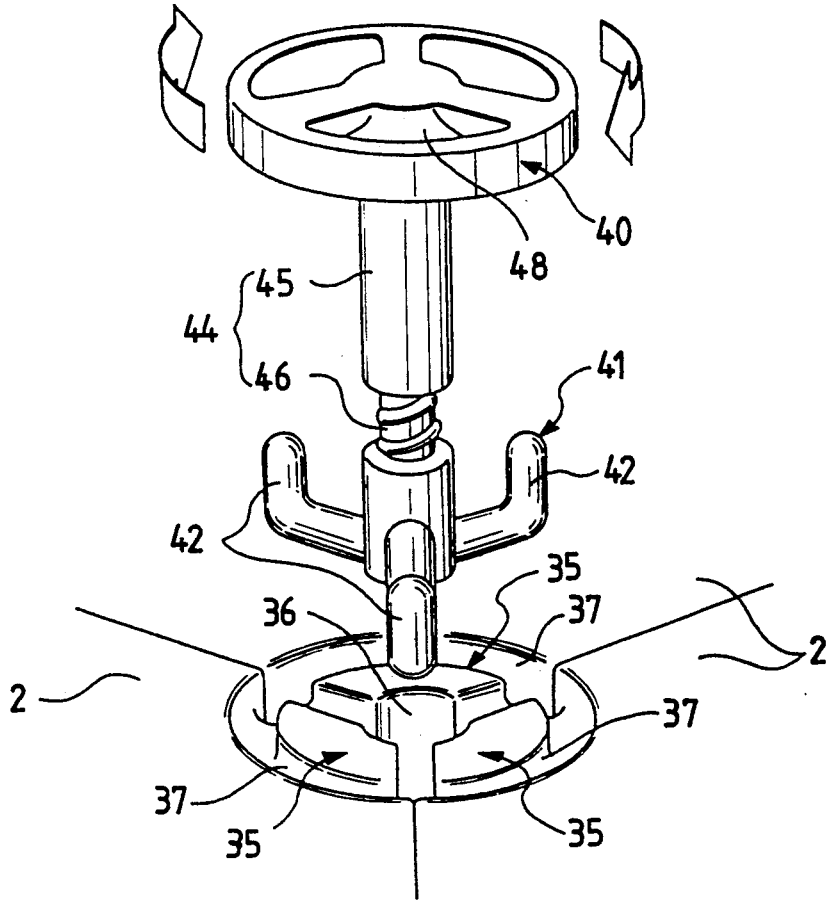
FIG. 13 is a perspective view of the coupling device in the third embodiment.
Figure 14:
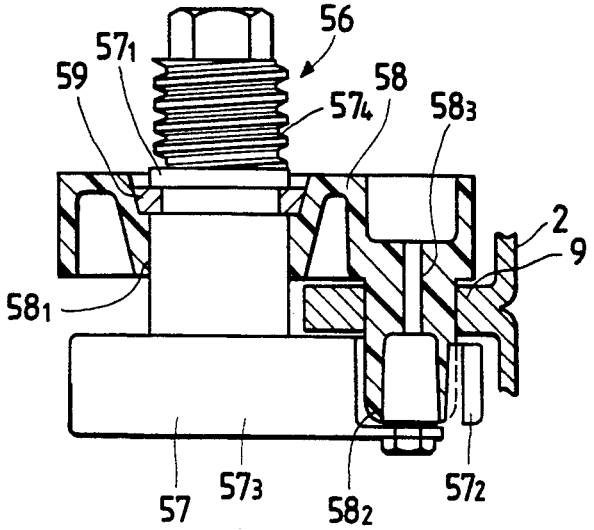
FIG. 14 is a fragmentary sectional view of the float coupling device according to a fourth embodiment of the present invention.
Figure 15:
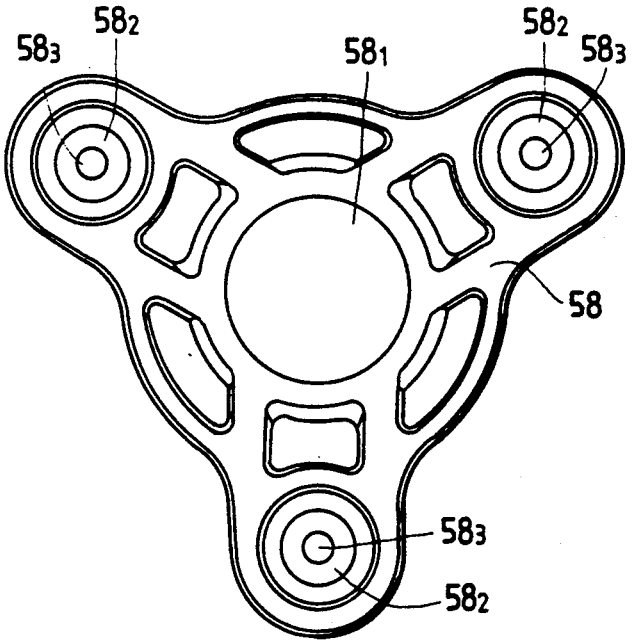
FIG. 15 is a bottom view of a pin plate forming the float coupling device.

FIGS. 11, 12 and 13 show a third embodiment of the invention.

In the third embodiment, the middle portion of each vertical groove 7 is expanded into an expanded portion 35, so that when three float corners are set together, the outer surfaces of the expanded potions 35 define a cylinder-shaped tightening hole 36.

An arcuate groove 37 forming fastening means is formed in the upper surface of the expanded portion 35. In addition, a bottomed circular locking hole 38, which also forms the fastening means, is formed in the lower surface of the expanded portion 35. When three float corners are set together, the three arcuate grooves 37 lie like a ring around the vertical axis 4, with which a disk-shaped upper locking part 40 is detachably engaged. In this case, the three locking holes 38 are arranged around the vertical axis 4 at equal angular intervals. A lower locking part 41 is detachably engaged with the locking holes 38. More specifically, the lower locking part 41 has three arms 42 which are extended radially outwardly of the vertical axis 4 and are arranged at equal angular intervals, so that the three arms 42 are detachably engaged with the above-described locking holes 38. That is, the upper locking part 40 and the lower locking part 41 are engaged in the above-described manner to connect the floats 2 to one another.

The upper locking part 40 is slidably rotatable on the arcuate grooves 37 around the vertical axis 4. The upper surface of the upper locking part 40 is substantially flush with the upper surfaces 5 of the floats 2, while the lower surface of the lower locking part 41 is substantially flush with the lower surfaces 6 of the floats 2.

In FIG. 11 and 13, reference numeral 44 designates tightening means which comprises: a nut 45 integral with the upper locking part 40; and a bolt 46 which is integral with the lower locking part 41 and threadably engaged with the nut 45. The nut 45 and the bolt 46 are inserted along the vertical axis 4 into the aforementioned tightening hole 36.

The upper locking part 40 has three operating recesses 48 in the upper surface. The fingers of the operator are inserted into those operating recesses 48 to turn the upper locking part 40 together with the nut 45.

In connecting the floats 2 to one another, the nut 45 is slidably engaged with the bolt 46 in advance as shown in FIG. 13, and then the arms 42 are inserted into the spaces defined by the expanded portions 35 adjacent to one another, respectively (as indicated by the phantom lines in FIG. 12).

Under this condition, the arms 42 are turned 60° around the vertical axis 4 until the arms 42 are aligned with the locking holes 38, respectively (as indicated by the phantom lines in FIG. 11, and by the broken lines in FIG. 12). Thereafter, the upper locking part 40, the lower locking part 41, and the tightening means 44 are pulled upwardly, so that the arms 42 are engaged with the locking holes 38, respectively. When, under this condition, the upper locking part 40 is turned, the nut 45 is threadably engaged with the bolt 46, so that the upper locking part 40 is fitted in the arcuate grooves 37; that is, the upper locking part 40 and the lower locking part 41 are maintained engaged with each other (as indicated by the solid lines in FIG. 11).

FOURTH EMBODIMENT

FIGS. 14–21 show a fourth embodiment of the invention.

A float coupling device 56 according to the fourth embodiment of the present invention will be described in more detail.

The float coupling device 56 comprises an axle joint 57, a pin plate 58, and a ring joint 59, which are all made of hard synthetic resin.

The axle joint 57 is made up of a central shaft $57_1$, and three arms $57_3$ extended radially from the lower end of the central shaft in such a manner they are arranged around the central shaft at angular intervals of 120°. Each of the arms $57_3$ has an elastic hook $57_2$ at the end. The upper end portion of the central shaft $57_1$ is formed into a nut, The nut-shaped upper end portion merges with a threaded portion $57_4$. The central shaft $57_1$ has a central hole $57_5$ extended along its central axis. When a bar-shaped auxiliary cover member 53' is inserted, a bolt is inserted into the central hole $57_5$ and fixed with the nut. The central hole is utilized when the floats are fixedly stacked. A half of the upper surface of each of the arms $57_3$ of the axle joint 57 where the elastic hook $57_2$ is engaged with a pin shaft $58_2$, is tapered as shown in the part (b) of FIG. 16. Hence, even when the coupling protruded pieces 9 of the floats to be connected are vertically shifted from each other for instance by waves, they can be smoothly engaged with the pin shafts $58_2$.

The pin plate 58 is substantially in the form of a regular triangle with three corners rounded. The pin plate 58 has a pin plate hole $58_1$ at the center, and three pin shafts $58_2$ at the three vertexes, respectively, in such a manner that the pin shafts are extended downwardly. The pin shafts $58_2$ are made hollow, for reduction of the weight, and have drain holes $58_3$ so that no water is collected in the bottom.

The ring joint 59 is of split type, and it is used to prevent the axle joint 57 from coming off.

In the above-described embodiment, the floats 2 are hexagonal; however, the invention is not limited thereto or thereby. That is, the configuration of the floats may be modified freely as long as the resultant floats are equal in function to those described above, and can be coupled to one another with the coupling devices 56.

Now, a procedure of connecting the floats 2 to one another to form an artificial floating island 51 will be described.

First, a coupling device 56 is sub-assembled in advance in such a manner that the central shaft $57_1$ of the axle joint 57 is inserted into the pin plate hole $58_1$ of the pin plate 58 from behind in such a manner that the arms $57_3$ are positioned between the pin shafts $58_2$ of the pin plate 58, and the ring joint 59 is put on the central shaft $57_1$. Second, the coupling protruded pieces 9 of three hexagonal floats 2 are set together, and the pin shafts $58_2$ of the pin plate 58 of the sub-assembled coupling device 56 are inserted into the coupling holes 10 of the protruded pieces 9, respectively. Then, the axle joint 57 is turned until the elastic hooks $57_2$ engage with the pin shafts $58_2$, respectively. Thereafter, by tightening holes $53_1$ formed in the cover member 53 (shown in FIG. 18), the cover member 53 is threadably engaged with the top part of the coupling device 56. Thus, the artificial floating island 51 has been formed with a plurality of floats 2.

Now, one modification of the fourth embodiment will be described with reference to FIGS. 20 and 21. In the modification, floats stacked in two layers are floated on water.

In the modification, similarly as in the above-described case, the floats are assembled in two layers on the land, and then are moved to the water; or the floats may be assembled in two layers on the water directly.

Similarly as in the above-described embodiment, an upper layer of floats and a lower layer of floats are formed according to the following procedure: First, the axle joint 57 and the pin plate 58 are sub-assembled in advance in such a manner that the central shaft $57_1$ of the axle joint 57 is inserted into the pin plate hole $58_1$ of the pin plate 58 and the arms $57_3$ of the axle joint 57 are located between the pin shaft $58_2$. Second, the coupling protruded pieces 9 of hexagonal floats 2 adjacent to one another are put together, and the pin shafts $58_2$ of the pin plate 58 are inserted into the coupling holes 10 of the protruded pieces 9 thus put together. Under this condition, the ring joint 59 is put on the central shaft $57_1$, and then the axle joint 57 is turned around its central axis so that the elastic hooks $57_2$ are engaged with the pin shafts $58_2$. However, the procedure taken after the formation of the upper and lower layers of floats, is different because cover members 53 and members for connecting the floats $2_A$ in the lower layer and the floats $2_B$ in the upper layer are different in structure from those described above.

A cover member 53 put on each of the coupling devices 56 of the floats $2_A$, as shown in FIG. 20, is a hollow structure made of synthetic resin having a central hole 61 (hereinafter referred to as "a lower cover $53_A$", when applicable). The upper portion of the inner surface of the central hole 61 has a flange-shaped protruded piece $61_1$ at a predetermined position. The portion of the central hole 61 which is above the flange-shaped protruded piece is larger in diameter. A stay rod 62 for coupling the lower layer of floats $2_A$ and the upper layer of floats $2_B$ is inserted into the central hole 61. The flange-shaped protruded piece $61_1$ is tapered inwardly so as to facilitate the insertion of the lower end portion of the stay rod 62. The stay rod 62, as shown in FIG. 21, is made up of a first hollow cylindrical portion $62_1$ having recesses on the outside which is relatively large in diameter, an nut-buried upper portion $62_2$ which is extended upwardly from the hollow cylindrical portion and consists of a small cylindrical portion and a nut-shaped portion, and a lower portion $62_3$ consisting of a second hollow cylindrical portion relatively small in diameter the inner wall of which is threaded, the lower portion merging with the hollow cylindrical part $62_1$ through an annular recessed portion $62_4$. The edge of the opening of the second hollow cylindrical portion, and the edge of the lower end face of the first hollow cylindrical portion are rounded, so that, when the stay rod 62 is inserted from above, the lower end of the second hollow cylindrical portion of the lower portion $62_3$ is slid down the sloped portion of the flange-shaped protruded piece $61_1$ of the lower cover $53_A$. Finally, the flange-shaped protruded piece $61_1$ is fixedly fitted into the annular recessed portion $62_4$ of the stay rod 62. Under this condition, the stay rod 62 is threadably engaged with the threaded portion $57_4$ of the axle joint 57, so that the lower cover $53_A$ is put on the coupling device 56, thus covering the gaps between the adjacent floats $2_A$. By performing the above-described operations repeatedly; that is, by putting the lower covers $53_A$ coupled to the stay rods 62 on the coupling devices 56 in the above-described manner, the gaps between a given number of floats $2_A$ are covered.

Next, similarly as in the formation of the upper layer of floats $2_A$, floats $2_B$ are connected to one another with the coupling devices 56 to form a lower layer of floats $2_B$. In the lower layer of floats $2_B$, the central hole $57_5$ of the central shaft $57_1$ of the axle joint 57 of each of the coupling devices 56 is engaged with the upper portion $62_2$ of the respective stay rod 62. Under this condition, a relatively long bolt 63 having a threaded end portion is threadably engaged with the nut of the upper portion $62_2$ of the stay rod 62. In this case, the head of the long bolt 63 is in contact with the inside of the upper cover $53_B$. The upper cover $53_B$ is threadably engaged with the respective axle joint 57. Thus, the upper layer of floats $2_B$ has been connected to the lower layer of floats $2_A$. Each of the upper covers $53_B$ is so designed that the drain hole 64 in the bottom is expanded downwardly so as to be in contact with the upper surface of the pin plate 58; that is, the drain hole serves as means for preventing the turning of the upper cover $53_B$.

OTHER EMBODIMENTS

FIGS. 22, 23 and 24 show a fifth embodiment of the invention, in which each float 2 is regular-triangular as viewed from above.

FIG. 25 shows a sixth embodiment of the invention, in which each float 2 is square as viewed from above.

FIG. 26 shows a seventh embodiment of the invention. In the sixth embodiment, a floating island 1 is made up of the floats 2 employed in the first, fifth and sixth embodiments.

FIG. 27 shows an eighth embodiment of the invention. In the eighth embodiment, each float 2 is regular-triangular as viewed from above, and has a vertical groove 7 and a protruded piece 9 at the middle of each of the three sides. The vertical groove 7 and the protruded piece 9 form a coupling device 3.

FIG. 28 shows a ninth embodiment of the invention. In the ninth embodiment, each float 2 is square as viewed from above, and has a vertical groove 7 and a protruded piece 7 at the middle of each of the four sides. The vertical groove 7 and the protruded piece 9 form a coupling device 3.

FIG. 29 shows a tenth embodiment of the invention. In the tenth embodiment, each float 2 is regular-hexagonal as viewed from above, and has a vertical groove 7 and a protruded piece 7 at the middle of each of the six sides. The vertical groove 7 and the protruded piece 9 form a coupling device 3.

FIG. 30 shows an eleventh embodiment of the invention. In the eleventh embodiment, each float 2 is regular-octagonal square as viewed from above, and has a vertical groove 7 and a protruded piece 7 at the middle of each of the eight sides at the middle. The vertical groove 7 and the protruded piece 9 form a coupling device 3.

In the above-described embodiments, the coupling device 3 may be so modified that it is protruded above the floats 2, so as to be used as a support for a tent or a sunshade.

In addition, as shown in FIG. 31, in order to prevent, for instance, the fingers from being caught in the gaps between the floats 2, protrusions $2_1$ may be formed on the side walls of the floats. That is, even when the floats 2 are swung by waves, they are maintained spaced away from one another by means of the protrusions $2_1$, which eliminates the difficulty that for instance the fingers are caught in the gaps between the floats.

As was described above, the water-float coupling device of the invention comprises: the tightening means for maintaining the locking part engaged with the fastening means provided on the sides of a plurality of water-floats thereby to maintain the water-floats connected to one another. Hence, the floats are more positively connected to one another than in the prior art in which they are connected merely with the locking means. Hence, even when the floats are greatly moved relative to one another, for instance, waves, they will never be unintentionally disconnected from one another.

In addition, the float coupling device of the invention is designed as described above. Hence, the second locking member can be visually aligned with the fastening means with ease which are the coupling holes formed in the protruded pieces of the floats, and the central shaft of the first locking member can be inserted into the central hole of the second locking member. Therefore, by turning the central shaft of the first locking member, the locking part can be positively engaged with the fastening means. Thus, the float coupling device can be manufactured at low cost.

What is claimed is:

1. A water-float coupling device comprising:

a fastening means provided on at least one side of each of a plurality of floats;

said fastening means of two of said floats being horizontally juxtaposed;

a locking part detachably engaged with said horizontally juxtaposed fastening means of two of said floats; and tightening means for maintaining said locking part engaged with said juxtaposed fastening means, said juxtaposed fastening means being positioned in generally vertically parallel relationship to each other when said tightening means is tightened.

2. A water-float coupling device according to claim 1, wherein said fastening means comprises a plurality of protruded pieces which are respectively protruded from the side walls of said floats, each said protruded pieces being provided with a locking hole.

3. A water-float coupling device according to claim 2, wherein said locking part comprises an annular shaped locking part body, in which a plurality of locking protrusions are extended from the bottom of the annular locking part body and arranged around the central axis of said locking part body, and said locking protrusions are inserted in said locking holes, respectively.

4. A water-float coupling device according to claim 3, wherein said locking protrusions are arranged around the central axis of said locking part body at equal angular intervals.

5. A water-float coupling device according to claim 2, wherein said locking part comprises:

an upper locking part; and a lower locking part for threadedly engaging with said upper locking part, said lower locking part having a plurality of arms which are extended radially outwardly and are arranged so that the arms are detachably engaged with said locking holes respectively.

6. A water-float coupling device according to claim 5, wherein said arms are arranged around the central axis at equal angular intervals.

7. A water-float coupling device according to claim 5, wherein said tightening means comprises:

a nut integrally formed with said upper locking part: and a bolt integrally formed with said lower locking part for threadedly engaging with said nut.

8. A water-float coupling device according to claim 1, in which said tightening means comprises a bolt having a threaded lower end portion and a nut engaged with said threaded lower end portion of said bolt.

9. A water-float coupling device according to claim 8, in which said nut comprises:

a nut body which is engaged with said threaded lower end portion of said bolt;

a plurality of arms which are extended from said nut body radially outwardly and arranged around the central axis.

10. A water-float coupling device according to claim 9, wherein said arms are arranged around the central axis at equal angular intervals.

11. A water-float coupling device according to claim 10, further comprising:

a locking means attached to the lower end of each of said bolts for preventing said upper surfaces of said engaging recesses from coming below the lower ends of said locking protrusions.

12. A water-float coupling device according to claim 9, in which an engaging recess is formed in the upper surface of each of said arms of said nut in such a manner that the lower end portions of said locking protrusions is detachably engaged with said engaging recesses when said bolt and said nut are turned relative to each other.

13. A water-float coupling device according to claim 1, wherein said fastening means comprises a plurality of expanded portions which are respectively protruded from the side walls of said floats, each said expanded portions being provided with at least one locking hole.

14. A water-float coupling device according to claim 1, wherein said tightening means comprises elastic hooks; and said locking part comprises:

a first locking member comprising a central shaft, and arms extended radially from the lower end of said central shaft; and a second locking member having a central hole into which said first locking member is inserted, and retainers located radially outwardly of said central hole which are inserted into said fastening means provided on the side of said floats and which are engageable with said elastic hooks of said tightening means;

said central shaft of said first locking member being inserted into said central hole, and said first locking member being turned about the central axis until said elastic hooks are engaged with said retainer, said elastic hooks being integrally formed with said arms of said first locking member, respectively.

15. A water-float coupling device according to claim 14, wherein said coupling device is covered with a cover member.

16. A water-float coupling device according to claim 1, wherein:

said fastening means of said two of said floats and said fastening means of a third of said floats are horizontally juxtaposed;

said fastening means of said two and said third floats have respective expanded portions that define a substantially vertical tightening hole when said two and said third floats are set together for fastening;

said locking part having upper and lower portions;

first means for engaging said upper locking portion against an upper side of said expanded portions;

second means for engaging said lower locking portion against a lower side of said expanded portions;

said tightening means including respective locking projections of said upper and lower portions of said locking portion; and said locking projections extending through said tightening hole into engagement with each other.

17. A water-float coupling device according to claim 16 wherein:

one of said first and second engaging means includes groove means in the associated upper and lower side of said expanded portions engaging a disc-like member of the associated upper or lower locking portion, and the other of said first and second engaging means includes multiple locking holes in the associated lower or upper side of said expanded portions engaging respective arms of the associated lower or upper locking portion.

18. A water-float coupling device according to claim 16 wherein:

said locking projections of said tightening means are respective nut and bolt projections disposed in threaded engagement in said tightening hole to maintain said locking part portions of said two and third floats in tight engagement.

* * * * *